United States Patent [19]

Hutzenlaub

[11] Patent Number: 4,461,432

[45] Date of Patent: Jul. 24, 1984

[54] UNWINDING APPARATUS FOR WEBS OF MATERIAL, IN PARTICULAR PLASTIC FILMS

[75] Inventor: Armin S. P. Hutzenlaub, Wiehl, Fed. Rep. of Germany

[73] Assignee: Erwin Kampf GmbH & Co. Maschinenfabrik, Fed. Rep. of Germany

[21] Appl. No.: 341,994

[22] PCT Filed: Jun. 4, 1981

[86] PCT No.: PCT/EP81/00062

§ 371 Date: Jan. 15, 1982

§ 102(e) Date: Feb. 7, 1982

[87] PCT Pub. No.: WO81/03480

PCT Pub. Date: Dec. 10, 1981

[30] Foreign Application Priority Data

Jun. 7, 1980 [DE] Fed. Rep. of Germany ..... 3021532

[51] Int. Cl.[3] ..... B65H 17/20; B65H 23/18; B65H 23/32; B65H 59/00

[52] U.S. Cl. ..... 242/75.51; 226/97; 226/197; 242/76

[58] Field of Search ..... 242/75.51, 76, 49, 75.42, 242/75.43, 75.5, 75.53; 226/197, 97

[56] References Cited

U.S. PATENT DOCUMENTS

| | | | |
|---|---|---|---|
| 2,754,883 | 7/1956 | Secrest | 242/75.5 X |
| 2,945,637 | 7/1960 | Derrick et al. | 242/75.51 |
| 3,057,574 | 10/1962 | Justus | 242/75.43 |
| 3,156,399 | 11/1964 | Wadey | 226/97 |
| 3,312,415 | 4/1967 | Jeans | 242/75.43 |
| 3,455,192 | 7/1969 | Moore et al. | 242/75.43 X |
| 3,567,093 | 3/1971 | Johnson | 226/97 |
| 4,182,472 | 1/1980 | Peekna | 226/97 |
| 4,342,413 | 8/1982 | Reba | 226/197 X |

FOREIGN PATENT DOCUMENTS

| | | |
|---|---|---|
| 818735 | 7/1969 | Canada . |
| 2033738 | 1/1972 | Fed. Rep. of Germany . |
| 946342 | 1/1964 | United Kingdom . |

*Primary Examiner*—Stuart S. Levy
*Assistant Examiner*—Scott J. Haugland
*Attorney, Agent, or Firm*—Bacon & Thomas

[57] ABSTRACT

An unwinding apparatus for webs of material, in particular plastics films (5), comprising an unwinding shaft (2) which is driven by a motor generator (4), a direction-changing guide means (6), the interior of which is under an increased pressure and feeds an air cushion, and a driven direction-changing roller (9). The technical problem lies in suppressing pulsation phenomena when unwinding sensitive plastics films. The angle over which the web of material loops around the direction-changing guide means (6) is greater than 140°. The air pressure in the interior (17) of the direction-changing guide means is at least 3 times the pressure in the air cushion (20). A pressure measuring means (11) is provided for measuring the pressure in the air cushion (20), the output signal of the measuring means being used to regulate the motor generator (4).

4 Claims, 1 Drawing Figure

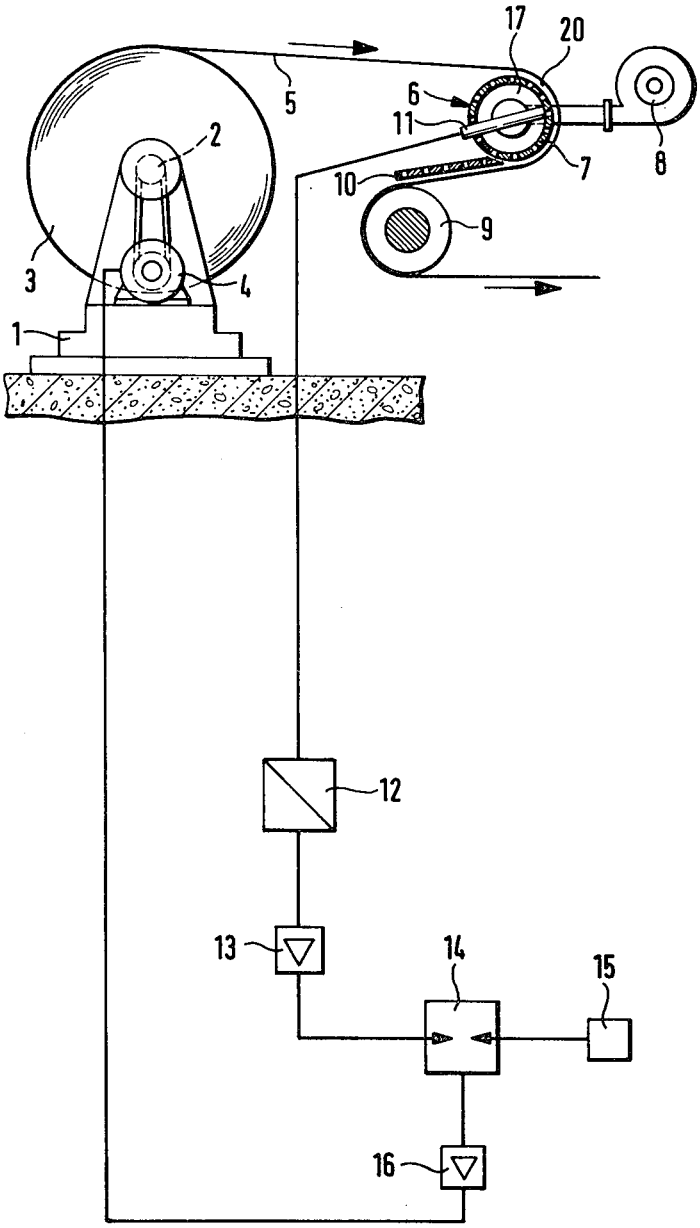
17
20
5
6
11
2
7
8
10
9
3
4
1
12
13
14
15
16

UNWINDING APPARATUS FOR WEBS OF MATERIAL, IN PARTICULAR PLASTIC FILMS

DESCRIPTION

Technical Field of the Invention

The invention relates to an unwinding apparatus for webs of material, in particular plastics films, having an unwinding shaft which is driven by a motor-generator, a direction-changing guide means, the interior of which is under an increased pressure and feeds an air cushion, and a driven direction-changing roller.

State of the Art

Plastics films are wound up in a more or less hot condition in a manufacturing plant, following a stretching section or the like. However, after the winding operation, ageing phenomena, shrinkage phenomena, crystallisation phenomena and the like still occur, and result in the length of the film being reduced. So that the wound coil of plastics film does not suffer due to those phenomena, which in general have the effect of causing shrinkage of the film, the film must be wound in a very loose winding so as to permit shrinkage of the plastics film. When loose rolls of this kind are stored, they suffer from the formation of out-of-roundness and other deformation phenomena. The winding becomes non-round and hangs down in what may be referred to as a belly below the coil.

When a coil which has been deformed in this manner is unwound in a processing installation, so-called pulsation phenomena occur, which result in abrupt changes in the tension of the web or the winding run. Such pulsation phenomena make the subsequent processing operation more difficult, in particular the operation of longitudinally cutting the web and the following operation of winding it up. In particular, the speed of operating on the web is detrimentally affected by the pulsation effects.

Attempts to overcome such pulsation phenomena by adapting the speed of rotation of the unwinding operation thereto have been found to be useless because, with the high mass of the coil to be unwound, it is technically not possible for the speed of unwinding rotation to be adaptively adjusted on a short-period basis. In this respect, account should be taken of the fact that the width of a coil may be several meters.

U.S. Pat. No. 2,945,637 discloses a direction-changing guide means wherein the web of material floats on an air cushion. This arrangement seeks to provide virtually inertia-less compensation of pulsation phenomena in a strip tension regulating means of a paper processing machine, wherein the motor generator which is connected to the unwinding roll is regulated by the increased pressure in the interior of the direction-changing guide means, which pressure produces the air cushion. The web of material is turned through about 90° and guided around a non-driven guide roller.

Tests have shown that, when unwinding plastics films, it is not sufficient for the films to be passed around the guide means over an angle of only 90° in order totally to compensate for possible out-of-roundness in the coil being unwound. It has also been found that a guide roller which is undriven and around which the film only passes over an angle of 90° is not sufficient for isolating the residual pulsation effect from the subsequent processing section of the plant.

Controlling the unwinding operation using the increased pressure for feeding the air cushion, as described in U.S. Pat. No. 2,945,637 has also not proved to be a success in regard to plastics films. The reason for this is that, in order to produce a uniform air cushion pressure, there must be a high pressure loss at the air outlet openings between the direction-changing guide means and the air cushion, so that the feed pressure is not representative in respect of the pressure in the air cushion.

SUMMARY OF THE INVENTION

The object of the present invention is to design an unwinding apparatus such that pulsation phenomena are completely eliminated even when unwinding sensitive or delicate plastics films from a loose roll.

This object is achieved by the combination of the following features:

(a) the angle over which the web of material is passed around the direction-changing guide means is greater than 140°;

(b) the air pressure in the interior of the direction-changing guide means is at least three times the pressure in the air cushion; and (c) for the purposes of measuring the pressure in the air cushion, there is a pressure measuring means, the output signal of which is utilised to regulate the motor generator.

Passing the web of material around the direction-changing guide means over a substantial angle has been found to be effective. In addition, the pressure in the interior of the direction-changing guide means must be at least three times the pressure in the air cushion. This provides a satisfactory feed of air for the air cushion, even in the event of pulsation phenomena. The pressure in the air cushion itself, which is proportional to the strip or band tension, is used as a control parameter for controlling the motor generator.

More particularly, the air cushion pressure signal is converted in a converter directly into an electrical proportional signal and supplied to the regulator means. Together with an output line of a reference value generator, a comparison circuit is actuated, the output line thereof carrying the regulating parameter for regulating the motor generator. This regulating means ensures that unwinding takes place at a constant speed of rotation. When the mean air pressure in the air cushion changes, the regulating means is altered on the one side and the speed of rotation of the motor generator is changed. This operation takes place very gradually as the diameter of the roll being unwound decreases. In this arrangement, the expensive booster system illustrated in U.S. Pat. No. 2,945,637 and the drive coupling for the winding-on operation are completely omitted.

The air forming the air cushion is discharged into the ambient atmosphere along the generating lines and at the annular segments at the ends. This gives rise to the danger of the film being caused to flutter. In order for the film to be guided in a smooth and undisturbed manner and in order for the air to issue from the air cushion as uniformly as possible, a flow discharge wall means in the form of an apertured plate member is arranged on the entry side and/or the exit side of the direction-changing guide means, substantially parallel to the web of film. Air is dissipated through the apertures in the plate member from the air cushion, thereby ensuring that the flow is smooth and turbulence is suppressed.

A further aspect of the invention provides that the length of the common tangent of the direction-changing guide means and the next following driven roller is less than 150 mm. It has been found desirable for the next following driven roller to be disposed as closely as possible to the air cushion direction-changing guide means in order for the plastics film to be taken over by the driven roller at the minimum possible distance from the guide means.

BRIEF DESCRIPTION OF THE DRAWING

An embodiment of the invention is described hereinafter with reference to the accompanying drawing, the single FIGURE of which shows a partly diagrammatic general view of the unwinding apparatus in accordance with the invention.

EMBODIMENT

The unwinding apparatus includes a support means 1 for an unwinding shaft 2 with a roll 3 of a plastics film, which is to be unwound. The unwinding shaft 2 is driven by a motor generator 4. From the roll 3, the plastics film 5 passes directly to a direction-changing guide means 6 which has a cylinder wall means 7 in the form of an apertured plate, which extends at least over an angle of 140°. An increased pressure is produced in the interior 17 of the direction-changing guide means 6 by a blower 8 so that air flows out through the apertures in the apertured plate member. That air produces an air cushion 20 between the direction-changing guide means 6 and the plastic film 5. The arrangement is such that the pressure in the interior 17 is from 2.5 to 4 times the pressure of the air cushion. The pressure in the interior 17 must be at least 3 times the pressure in the air cushion so as to permit uniform feed of air to the air cushion, which is sufficient for absorbing pulsation effects.

Following the direction-changing guide means, the plastics film 5 is taken over by a driven direction-changing roller 9. A flow discharge wall means 10 in the form of an apertured plate member is arranged substantially parallel to the path of movement of the web of film. The contact pressure of the plastics film against the direction-changing guide means and thus the pressure required for the air cushion is calculated in accordance with the following known formula:

$$p=2.\delta s/D$$

in which $\delta$ denotes the specific unwinding tension which is from 2 to 3 $N/mm^2$, s is the thickness of the film in millimeters and D is the diameter of the cylinder wall means of the direction-changing guide means in millimeters. It is found therefore that the pressure falls with increasing diameter of the direction-changing guide means. This is desirable as a lower pressure means less turbulence and thus less noise nuisance. The above formula also shows that the pressure is proportional to the thickness of the film so that the pressure of the air cushion can be preset in dependence on the thickness of the film.

The air cushion 20 which is produced by the air flowing out of the direction-changing guide means 6 through the plate member 7 absorbs pulsation effects in the web of film in a virtually inertia-less manner. For the mass of the air cushion and the web of film passing thereover is very low. The air of the air cushion flows away primarily in the peripheral direction. The air component which is discharged in the axial direction is comparatively small and does not have a detrimental effect on the air cushion. The flow discharge wall member 10 serves to dissipate air from the cushion in the region of the discharge flow of air, thereby preventing the formation of turbulence in the discharge flow region, thereby giving a uniform discharge flow.

Desirably, the driven roller 9 is disposed as close as possible to the direction-changing guide means 6 so that the common tangent of the direction-changing guide means and the next following drive roller is less than 150 mm in length.

The invention permits regulation of the speed of rotation used in the unwinding operation, and thus provides for uniform unwinding. A pressure measuring tube 11 is arranged in the region of a discharge flow aperture in the plate member 7 so that the pressure in the air cushion 20 can be measured by means of the pressure measuring tube 11. The pressure in the air cushion 20 is converted in a transducer 12 into a current which, after amplification in an amplifier 13, is fed into a comparison circuit 14. The other input of the comparison circuit is connected to the output line of a reference value generator 15. On its output line, the comparison circuit 14 produces a regulating voltage which is amplified in an amplifier 16. The amplified voltage is fed to the motor generator 4 and regulates the speed of rotation of the motor generator 4 and thus the speed of rotation of the unwinding shaft 2 in such a way that the pressure within the air cushion 20 remains at a constant value which is preset by the reference value generator 15. A constant pressure within the air cushion means a constant value in respect of the strip tension in the unwinding operation. In this way, the speed of rotation used in the unwinding process can be easily regulated in accordance with the invention.

I claim:

1. In an unwinding apparatus for webs of material, in particular plastic films, having a roll of the web material, the circumference of which may be out-of-round, supported on an unwinding shaft driven by a motor-generator and a driven direction-changing roller, the improvements comprising:

(a) a direction-changing guide means having a foraminous wall defining a hollow interior, the web material passing around the guide means through an angle of at least 140°;

(b) a source of pressurized air connected to the guide means such that pressurized air is supplied to the interior of the guide means, a portion of the air passing out through the foraminous wall to form an air cushion between the guide means and the web material, the air pressure in the interior of the guide means being at least three times the pressure of the air cushion to prevent the web material from coming into contact with the guide means during pulsations in the web caused by the out-of-roundness of the web roll;

(c) pressure measuring means to measure the air pressure in the air cushion;

(d) control means connected to the pressure measuring means and the motor-generator to regulate the motor-generator as a function of the pressure in the air cushion; and, (e) a discharge flow wall means in the form of an apertured plate located adjacent the exit side of the direction changing guide means substantially parallel to the web of film for dissipating the air cushion through apertures in the plate.

2. An unwinding apparatus according to claim 1 wherein the driven direction-changing roller (9) directly follows the direction-changing guide means (6).

3. An unwinding apparatus according to claim 1 wherein the driven direction-changing roller (9) has the web of material passing therearound at least over an angle of 140° or more and has a rubberised circumferential layer.

4. An unwinding apparatus according to claim 3 wherein the length of a common tangent between the direction-changing guide means (6) and the direction-changing roller (9) is less than 140 mm.

* * * * *